US008420919B2

(12) United States Patent
Miyajima

(10) Patent No.: US 8,420,919 B2
(45) Date of Patent: Apr. 16, 2013

(54) DRUM COUPLING SYSTEM

(75) Inventor: Hideyuki Miyajima, Nagoya (JP)

(73) Assignee: Hoshino Gakki Co., Ltd., Aichi (JP)

( * ) Notice: Subject to any disclaimer, the term of this patent is extended or adjusted under 35 U.S.C. 154(b) by 0 days.

(21) Appl. No.: 13/212,201

(22) Filed: Aug. 18, 2011

(65) Prior Publication Data

US 2012/0318118 A1 Dec. 20, 2012

(30) Foreign Application Priority Data

Jun. 15, 2011 (JP) ..... 2011-133462

(51) Int. Cl.
*G10D 13/02* (2006.01)

(52) U.S. Cl.
USPC ..... 84/421

(58) Field of Classification Search ..... 84/421
See application file for complete search history.

(56) References Cited

U.S. PATENT DOCUMENTS

| | | | | | |
|---|---|---|---|---|---|
| 2,588,830 | A * | 3/1952 | Haanstad | 84/421 |
| 3,021,744 | A * | 2/1962 | Kester | 84/421 |
| 4,387,839 | A * | 6/1983 | Dranchak | 224/265 |
| 5,054,357 | A * | 10/1991 | Pyle | 84/421 |
| 5,691,492 | A * | 11/1997 | May | 84/421 |
| 7,276,653 | B2 * | 10/2007 | Shimada | 84/421 |
| 7,671,261 | B1 * | 3/2010 | Momose | 84/421 |
| 8,093,479 | B2 * | 1/2012 | Schafer et al. | 84/421 |
| 2006/0137506 | A1 * | 6/2006 | May | 84/327 |
| 2009/0165630 | A1 * | 7/2009 | Hallerberg | 84/421 |

* cited by examiner

*Primary Examiner* — David Warren
*Assistant Examiner* — Robert W Horn

(57) ABSTRACT

A drum coupling system is configured as a coupling system for coupling various marching drums such as a snare drum, a tenor drum, and a bass drum to marching carriers and drum stands for the various marching drums, respectively. In the drum coupling system, a coupling structure for the various marching drums to the respective marching carriers and a coupling structure for the various marching drums to the respective drum stands are the same.

10 Claims, 12 Drawing Sheets

DRUM COUPLING SYSTEM

BACKGROUND OF THE INVENTION

The present invention relates to a drum coupling system used for coupling a marching drum such as a snare drum and a tenor drum to a fixture such as a marching carrier and a drum stand.

During a parade and the like, a player plays the marching drum while standing still or walking. In this case, a marching carrier is used as a fixture for attaching the marching drum to the player's body. A drum stand is used as a fixture for placing a marching drum on the road surface during a break in music playing. For example, the specification of U.S. Pat. No. 5,691,492 discloses a two-point supporting marching carrier for supporting a marching drum by means of a pair of rods as the marching carrier for a snare drum and a tenor drum. A four-point marching carrier for supporting a drum by means of a pair of hooks and a pair of rods is also disclosed as the marching carrier for a bass drum. Drum stands dedicated to each type of marching drums are used.

As described above, marching carriers and drum stands that are dedicated to each type of marching drum are provided. For this reason, an operation of attaching a marching drum to a marching carrier is different from an operation of attaching a marching drum to a drum stand. Also, an operation of attaching a marching drum to a marching carrier for a snare drum and a tenor drum is different from an operation of attaching a marching drum to a marching carrier for a bass drum. Similarly, operations of attaching a marching drum to various drum stands for a snare drum, a tenor drum and a bass drum are different from one another. Thus, disadvantageously, the attaching operation of a marching drum is troublesome and difficult for the player.

SUMMARY OF THE INVENTION

An objective of the present invention is to provide a drum coupling system that can eliminate the burden related to the attaching operation of a marching drum.

To achieve the foregoing objective and in accordance with one aspect of the present invention, a drum coupling system is provided that is adapted for coupling a marching drum to a marching carrier used for attaching the marching drum to a player's body or a drum stand used to mount the marching drum thereon. The drum coupling system includes a coupling structure for coupling the marching drum to the marching carrier and a coupling structure for coupling the marching drum to the drum stand, and the coupling structures are the same.

DETAILED DESCRIPTION OF THE PREFERRED EMBODIMENTS

An embodiment of a drum coupling system 10 according to the present invention will be described below with reference to FIGS. 1 to 11C.

Figure 1:
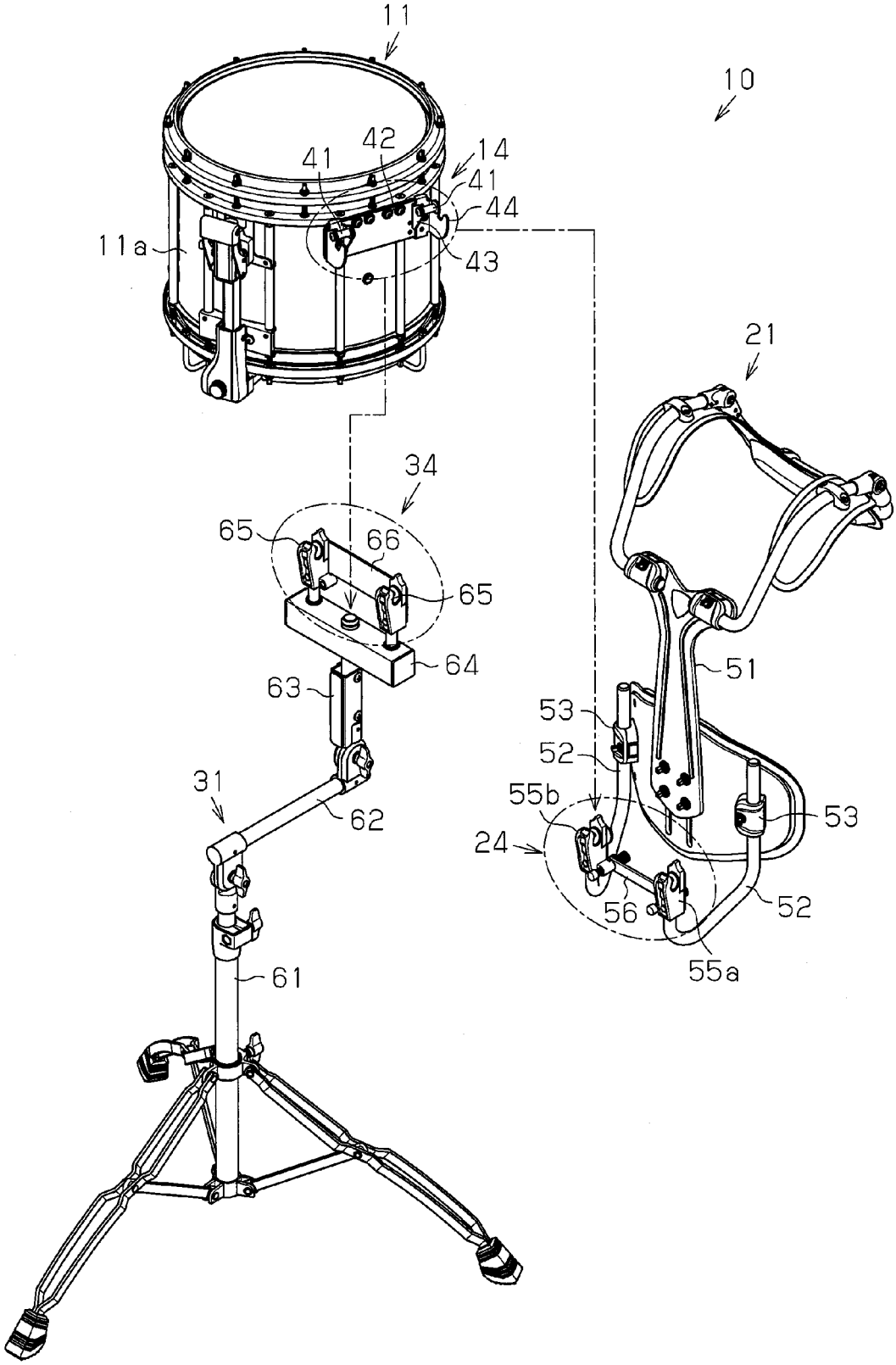
FIG. 1 is a schematic perspective view showing a snare drum, a snare drum marching carrier and a snare drum stand, to which an embodiment of a drum coupling system is applied according to the present invention.
Figure 8:
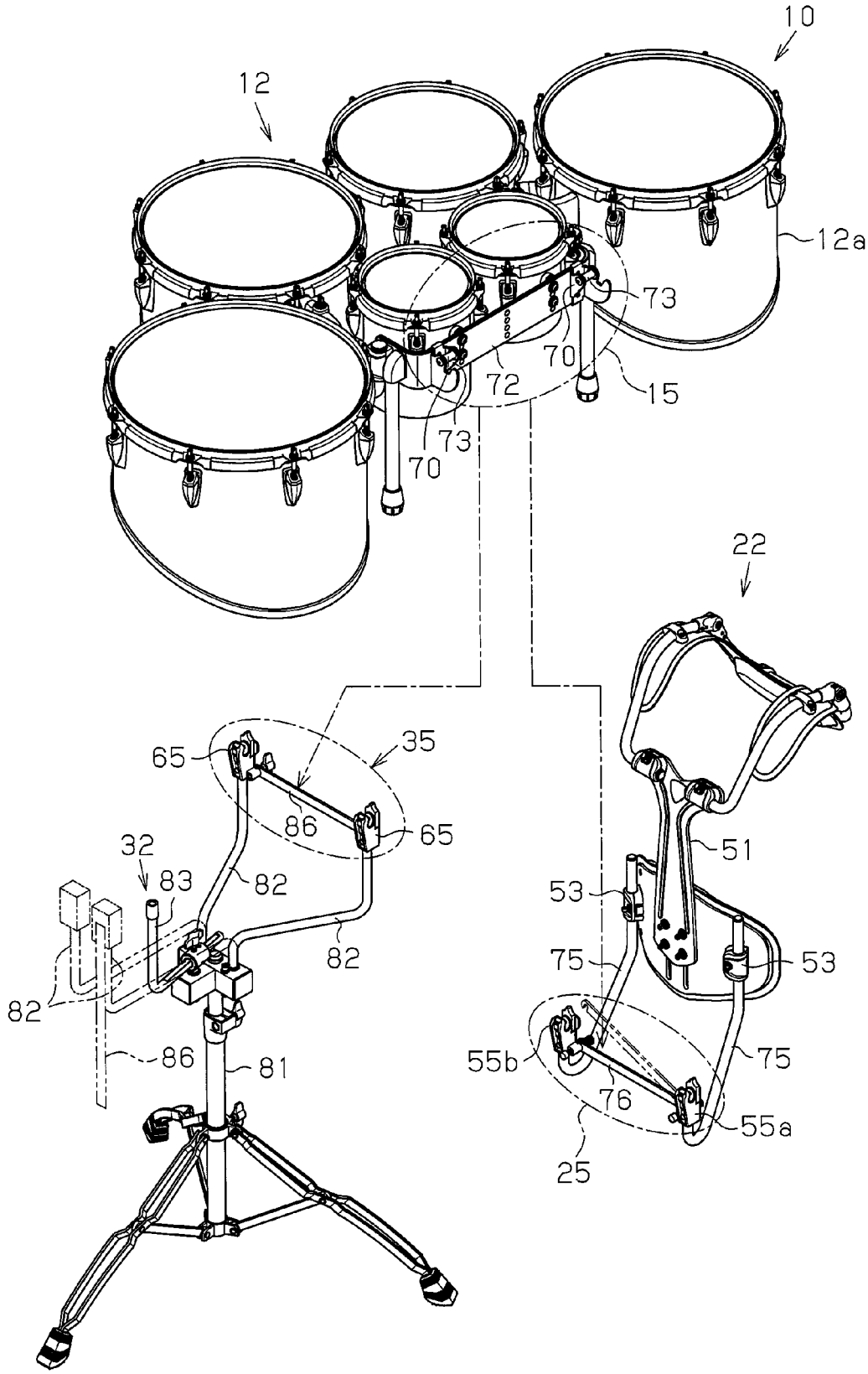
FIG. 8 is a schematic perspective view showing a tenor drum, a tenor drum marching carrier and a tenor drum stand, to which an embodiment of a drum coupling system is applied according to the present invention.
Figure 9:
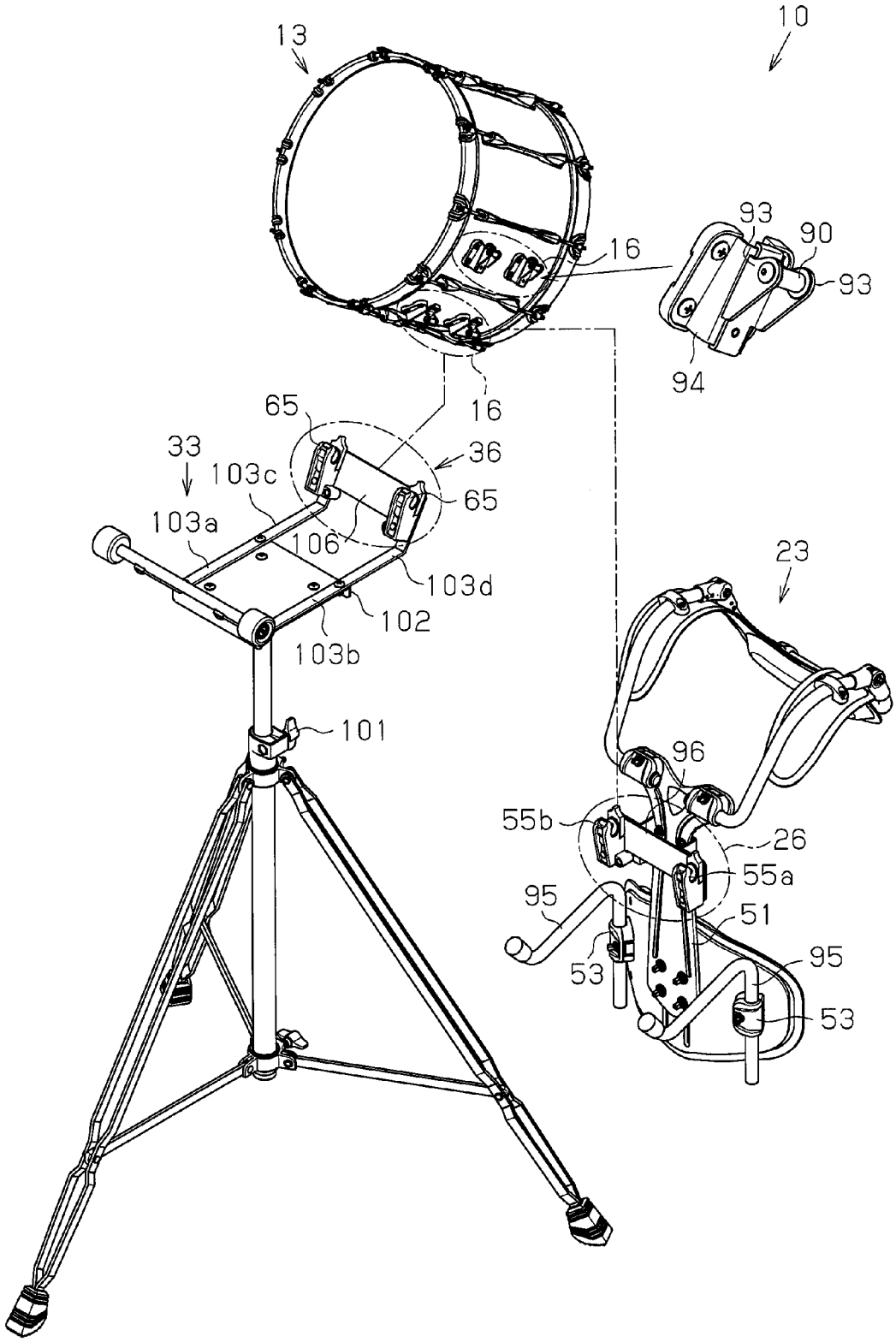
FIG. 9 is a schematic perspective view showing a bass drum, a bass drum marching carrier and a bass drum stand, to which a drum coupling system according to an embodiment of the present invention is applied.

As shown in FIG. 1, FIGS. 8 and 9, the drum coupling system 10 includes a drum-side coupling device 14, 15, 16 fixed to a marching drum such as a snare drum 11, a tenor drum 12 or a bass drum 13; a carrier-side coupling device 24, 25, 26 fixed to a marching carrier such as a snare drum carrier 21, a tenor drum carrier 22 or a bass drum carrier 23; and a stand-side coupling device 34, 35, 36 fixed to a drum stand such as a snare drum stand 31, a tenor drum stand 32 or a bass drum stand 33. That is, the drum coupling system 10 is configured as a coupling system for coupling various marching drums to marching carriers and drum stands for marching drums, respectively. In the drum coupling system 10, the coupling structure for coupling the various marching drums to the respective marching carriers and the coupling structure for coupling the various marching drums to the respective drum stands are the same.

First, the system for coupling the snare drum 11 to the snare drum carrier 21 and the snare drum stand 31 will be described with reference to FIGS. 1 to 7.

Figure 2A:
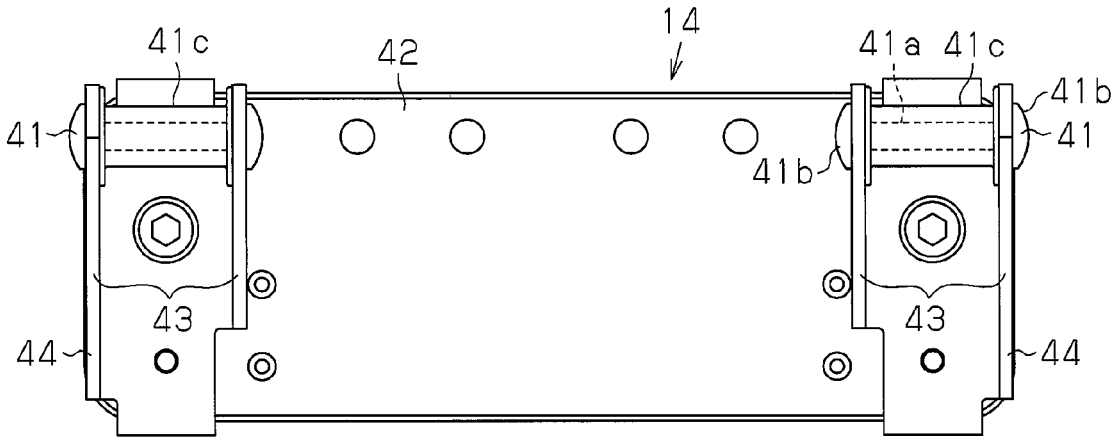
FIG. 2A is a front view of a drum-side coupling device.
Figure 2B:
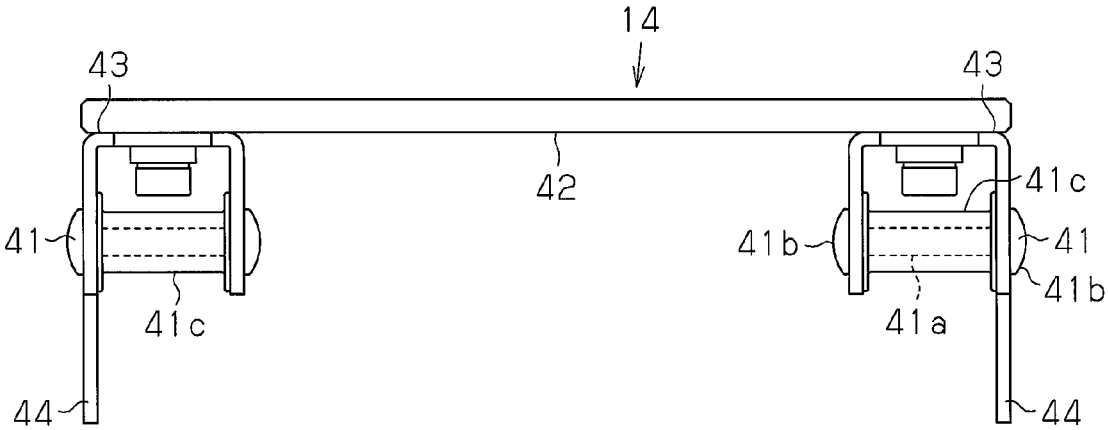
FIG. 2B is a top view of the drum-side coupling device.

As shown in FIG. 1, the drum-side coupling device 14 is fixed in the vicinity of an upper end of a circumferential surface of the snare drum 11. As shown in FIG. 2A, the drum-side coupling device 14 is configured by a pair of coupling shafts 41 in a lateral direction and a bracket 42 for fixing the coupling shafts 41 to the snare drum 11. The bracket 42 is substantially rectangular. A coupling fitting 43 is attached on each of both ends of the bracket 42. As shown in FIG. 2B, the coupling fitting 43 has a substantially U-shaped cross section. Each of the coupling shafts 41 is fixed to the coupling fitting 43. Of a pair of sidewalls forming the coupling fitting 43, the outer sidewall is wider than the inner sidewall. The outer sidewall functions as a guard member 44 for preventing foreign matter from entering a coupling part of the snare drum 11 and the snare drum carrier 21 from the outside. The coupling shafts 41 are made of a high-strength metal such as iron. Each of the coupling shafts 41 has a shaft part 41*a* and dish parts 41*b* provided on both ends of the shaft part 41*a*. A resin cylindrical body 41*c* is attached to the shaft part 41*a*.

As shown in FIG. 1, the snare drum carrier 21 includes a carrier main body 51 attached to the player's body, a pair of rods 52 for supporting the snare drum 11 and the carrier-side coupling device 24. The rods 52 protrude downward from a pair of holders 53 fixed to the carrier main body 51, respectively. Each of the rods 52 is substantially J-shaped, their ends being oriented upward. Each rod 52 is removably attached to the carrier main body 51 via each holder 53 so as to be positionable in the vertical direction. The carrier-side coupling device 24 is fixed so as to couple the ends of the rods 52 to each other.

Figure 3A:
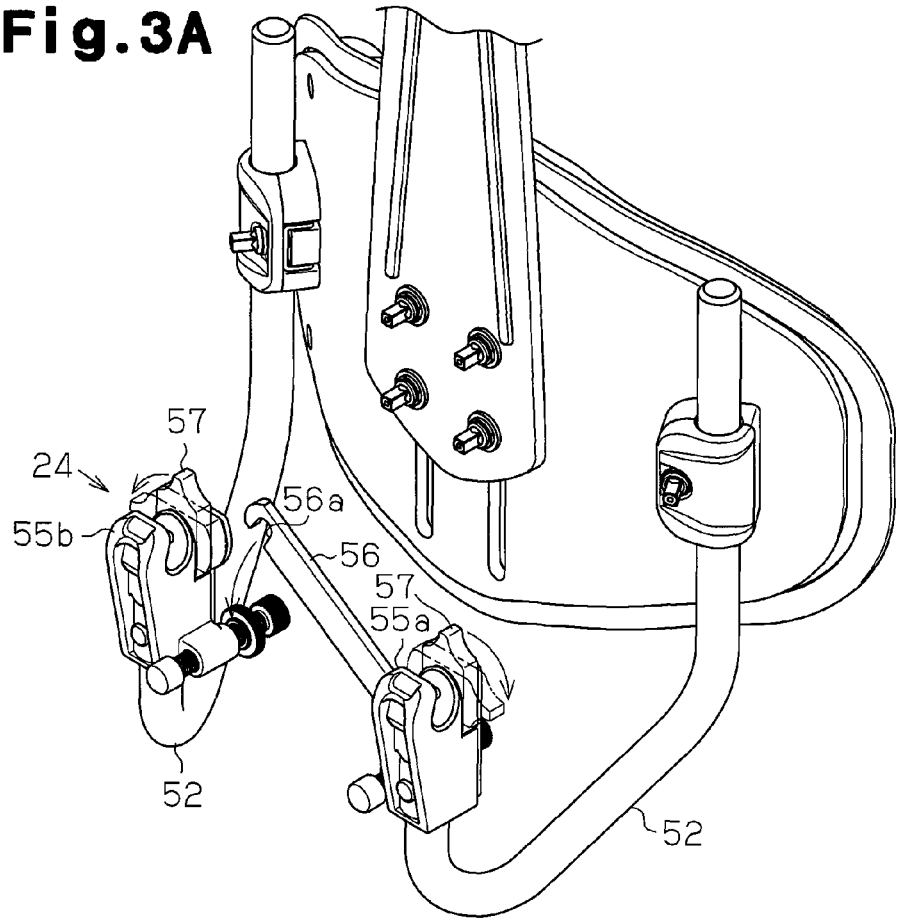
FIG. 3A is an enlarged perspective view showing the vicinity of a carrier-side coupling device of a snare drum carrier.

As shown in FIG. 3A, the carrier-side coupling device 24 includes a pair of hooks 55*a* and 55*b* for pivotably supporting the coupling shafts 41 provided on the snare drum 11. An elongated bridging member 56 is attached to the first hook 55*a* shown in the right of the drawing. A recess 56*a* opened downward is formed on an end of the bridging member 56. The recess 56*a* of the bridging member 56 is fitted into a lower end of the second hook 55*b* shown in the left of the drawing. That is, the bridging member 56 is pivotably attached to the lower end of the first hook 55*a* to serve as a bridge between the first and second hooks 55*a* and 55*b*.

Figure 3B:
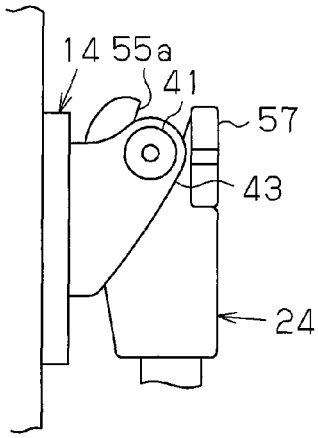
FIG. 3B is a schematic side view showing the state where a lock lever is switched to a locked position.
Figure 3C:
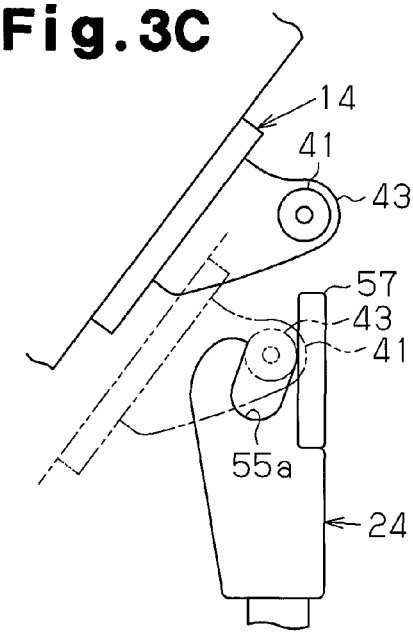
FIG. 3C is a schematic side view showing the state where the lock lever is switched to an unlocked position.

Each of the first and second hooks 55*a* and 55*b* is pivotably supported by a resin lock lever 57. The lock lever 57 is switched between a locked position at which its front end is oriented sideways and an unlocked position at which the front end is oriented upward. As shown in FIG. 3B, when the lock lever 57 is switched to the locked position, the lock lever 57 itself restricts upward movement of the coupling fitting 43, thereby locking the coupling shafts 41 so that they may not be disengaged from the hooks 55*a* and 55*b*. As shown in FIG. 3C, when the lock lever 57 is switched to the unlocked position, restriction of movement of the coupling fitting 43 by the lock lever 57 is removed, thereby unlocking the coupling shaft 41 in the hook 55*b*. That is, the lock lever 57 constitutes a lock mechanism for preventing the coupling shafts 41 from escaping from the hooks 55*a* and 55*b*.

Figure 4A:
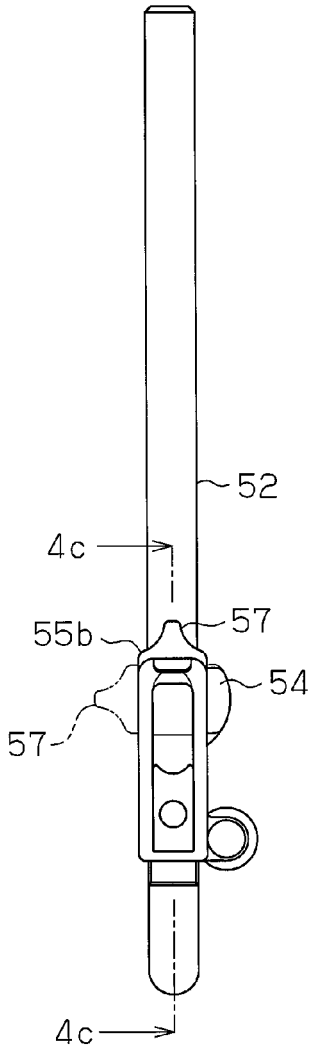
FIG. 4A is a front view showing a hook attached to a left rod.
Figure 4B:
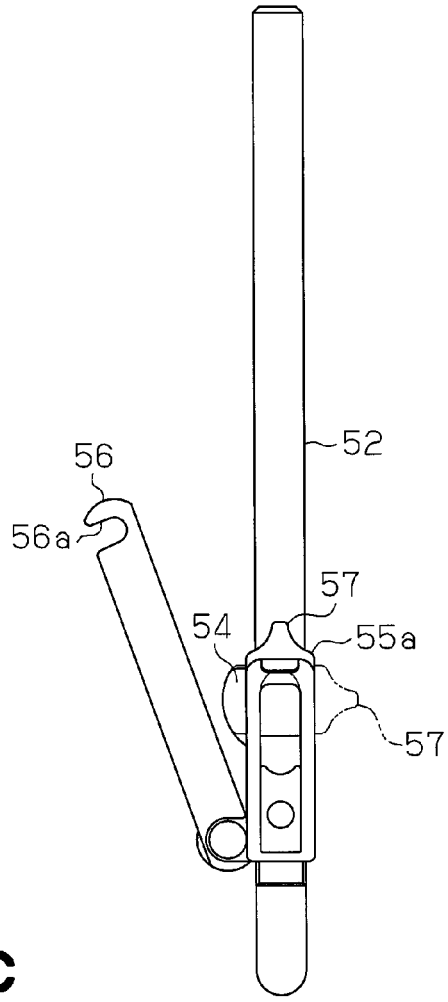
FIG. 4B is a front view showing a hook attached to a right rod.
Figure 4C:
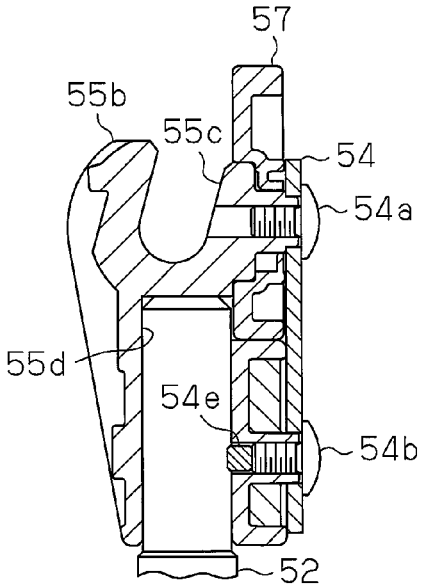
FIG. 4C is a sectional view along line 4C-4C in FIG. 4A.

As shown in FIGS. 4A and 4B, a plate member 54, which is a metal supporting member, is fixed to each of back surfaces of the hooks 55*a* and 55*b*. As shown in FIG. 4C, the plate members 54 each hold a central part of the lock lever 57 between the hooks 55*a* and 55*b* and are partially exposed when viewing the hooks 55*a* and 55*b* from the front. The plate members 54 are fixed to the back surfaces of the hooks 55*a* and 55*b* by a pair of bolts 54*a* and 54*b*. The upper bolt 54*a* of the pair is screwed into a rear wall of each of the hooks 55*a* and 55*b*, with its front end oriented toward a vertical hole 55*c* of each of the hooks 55*a* and 55*b*. A lower hole 55*d* into which the front end of the rod 52 is introduced and fixed is formed on each of the hooks 55*a* and 55*b*. The lower bolt 54*b* is screwed into a rear wall of each of the hooks 55*a* and 55*b*, with its front end oriented toward the lower hole 55*d* of each of the hooks 55*a* and 55*b*. A resin cylindrical cap 54*e* is attached to the front end of the lower bolt 54*b*.

Figure 5A:
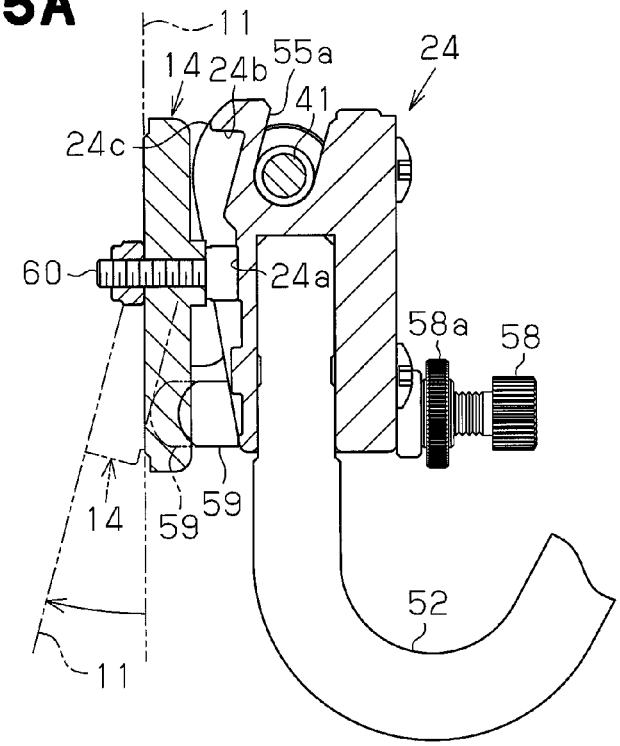
FIG. 5A is an enlarged side sectional view showing a coupling structure for coupling the snare drum to the snare drum carrier.

As shown in FIG. 5A, an adjusting screw 58 is threaded into a lower part of the carrier-side coupling device 24, with its front end oriented forward. A cap 59 that presses the drum-side coupling device 14 is attached to the front end of the adjusting screw 58. A thin disc-like lock nut 58*a* is screwed into a bottom end of the adjusting screw 58. The lock nut 58*a* locks the adjusting screw 58 so that the adjusting screw 58 does not become loose from the state of being fastened to the hooks 55*a* and 55*b*. As expressed by lines formed by a long dash alternating with two short dashes in the drawing, by rotating the adjusting screw 58 and moving the adjusting screw 58 to the left in the drawing, the lower end of the drum-side coupling device 14 is pressed forward by the front end of the cap 59. Thus, the drum-side coupling device 14 pivots about the coupling shafts 41 counterclockwise in the drawing, so that an attachment angle of the snare drum 11 to the snare drum carrier 21 can be varied. That is, the adjusting screw 58 and the cap 59 constitute an angle adjusting mechanism for adjusting the angle of the beating surface of the snare drum 11 attached to the snare drum carrier 21. The angle of the beating surface of the snare drum 11 is the angle of the beating surface relative to a horizontal plane.

Figure 5B:
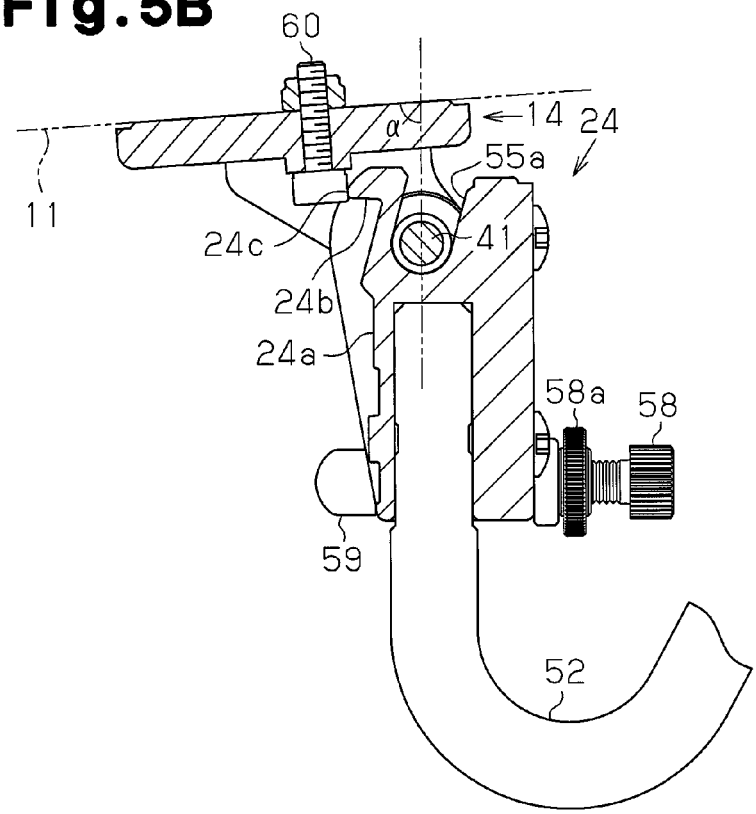
FIG. 5B is an enlarged side sectional view showing the coupling structure when the snare drum is tilted up.

A first wall surface 24*a* that comes in contact with a bolt 60 of the drum-side coupling device 14 during playing of the snare drum 11 is provided at the center of the carrier-side coupling device 24. The first wall surface 24*a*, together with the angle adjusting mechanism, holds the beating surface of the snare drum 11 horizontally. An angled part having a cross section in the form of an inverted L is provided at an upper end of the carrier-side coupling device 24. A wall surface of the angled part that faces downward constitutes a second wall surface 24*b*. Since the head of the bolt 60 would be caught by the second wall surface 24*b*, even if the coupling shafts 41 in the hook 55*b* are unlocked, the coupling shafts 41 are held and do not escape from the hooks 55*a* and 55*b*. Furthermore, as shown in FIG. 5B, a third wall surface 24*c*, which engages the head of the bolt 60 in a pivoted state of the snare drum 11, is provided on the upper end of the carrier-side coupling device 24, as shown. That is, the third wall surface 24*c*, together with the bolt 60 of the drum-side coupling device 14, constitutes a restricting device for restricting the snare drum 11 from pivoting around the coupling shafts 41 beyond a first angle $\alpha$.

As shown in FIG. 1, the snare drum stand 31 includes a stand main body 61 with a tripod, a coupling pipe 62, a vertically extending stopper 63, a horizontally extending supporting part 64 substantially in the form of a rectangular parallelepiped, and the stand-side coupling device 34. The stand-side coupling device 34 is fixed to an upper surface of the supporting part 64. The stand-side coupling device 34 has a pair of hooks 65 for pivotably supporting the coupling shafts 41 and a rectangular bridging member 66. The bridging member 66 is fixed to the hooks 65 and serves as a bridge between the hooks 65.

Figure 6A:
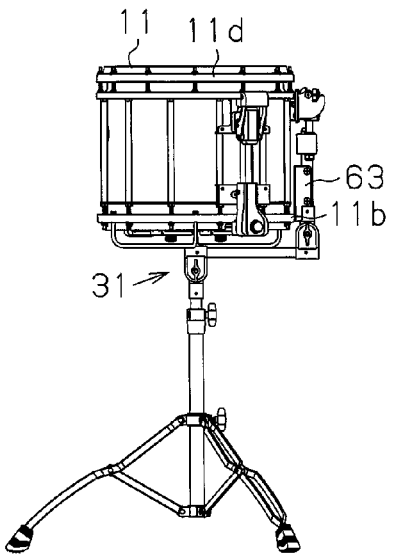
FIG. 6A is a side view showing the state where the snare drum is attached to the snare drum stand.
Figure 6B:
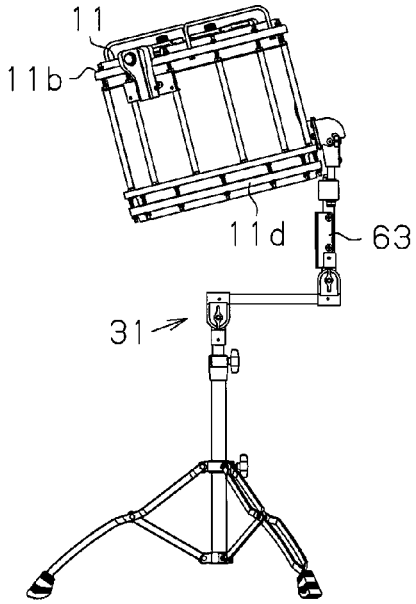
FIG. 6B is a side view showing the state where the snare drum in the upside-down state is attached to the snare drum stand.
Figure 7:
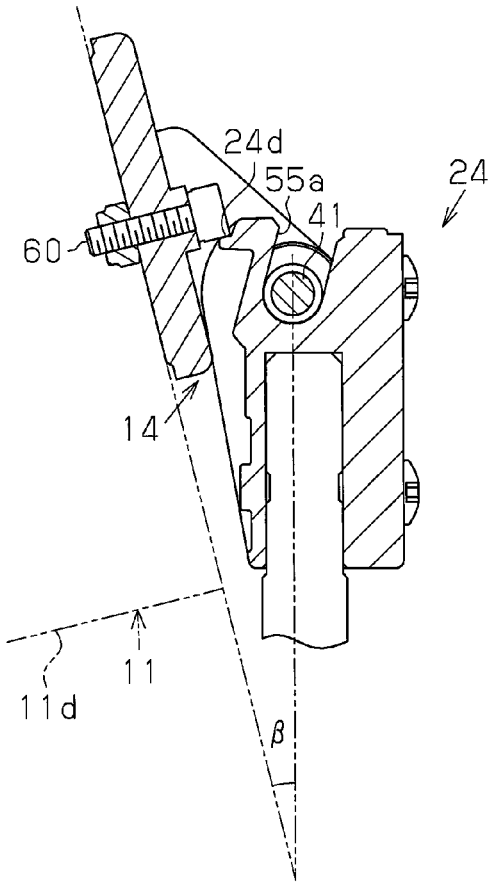
FIG. 7 is an enlarged side sectional view showing the coupling structure for coupling the snare drum to the snare drum stand in the state shown in FIG. 6B.

As shown in FIG. 6A, when the snare drum 11 is attached to the snare drum stand 31 and played, a lower hoop 11*b* of the snare drum 11 comes into contact with a front surface of a lower part of the stopper 63 and horizontally holds the beating surface 11*d* of the snare drum 11. As shown in FIG. 6B, when the snare drum 11 is tuned, the snare drum 11 in the upside-down state is attached to the snare drum stand 31. At this time, as shown in FIG. 7, since the head of the bolt 60 of the drum-side coupling device 14 is caught by an upper end 24*d* of a front surface of the carrier-side coupling device 24, the snare drum 11 is held and is blocked from pivoting around the coupling shafts 41 beyond a second angle β.

Next, a system for coupling the tenor drum 12 to the tenor drum carrier 22 and the tenor drum stand 32 will be described with reference to FIG. 8. Detailed description of parts similar to those in the above-mentioned drum-side coupling device 14, snare drum carrier 21, snare drum stand 31 and the like is omitted.

As shown in FIG. 8, the drum-side coupling device 15 is configured by a pair of coupling shafts 70 and a bracket 72 for fixing the coupling shafts 70 to the vicinity of an upper end of the circumferential surface of the tenor drum 12. The bracket 72 is substantially U-shaped and horizontally long. A coupling fitting 73 is attached to each of both corner parts of the bracket 72. The length of the bracket 72 and the distance between the coupling shafts 70 are set to be larger than those in the case where the drum coupling system 10 is used for coupling the snare drum 11 and the snare drum carrier 21.

The tenor drum carrier 22 includes the carrier main body 51, a pair of rods 75 and the carrier-side coupling device 25. Each of the rods 75 extends further forward and downward than the rods 52 of the snare drum carrier 21. By replacing the rods 52 of the carrier main body 51 with the rods 75 for the tenor drum, the tenor drum 12 is supported at a further forward and downward position than the snare drum 11. According to the length of the bracket 72 and the distance between the coupling shafts 70, the distance between the hooks 55*a* and 55*b* and the length of a bridging member 76 are set to be larger than those in the case where the drum coupling system 10 is used for coupling the snare drum 11 and the snare drum carrier 21.

The tenor drum stand 32 includes a stand main body 81, a pair of movable pipes 82 that can be opened/closed about an axis of the stand main body 81, a fixed pipe 83 as a stopper fixed to an upper end of the stand main body 81, and the stand-side coupling device 35. The stand-side coupling device 35 includes the pair of hooks 65 fixed to front ends of the movable pipes 82 and an elongated bridging member 86 attached to one of the hooks 65. A front end of the bridging member 86 is fitted into a lower end of the other of the hooks 65. That is, the bridging member 86 is pivotably attached to the lower end of one of the hooks 65 so as to serve as a bridge between the hooks 65. When not used, the tenor drum stand 32 is folded as represented by lines formed by a long dash alternating with two short dashes in FIG. 8.

Subsequently, a system for coupling the bass drum 13 to the bass drum carrier 23 and the bass drum stand 33 will be described with reference to FIGS. 9 to 11C. Detailed description of parts similar to those in the above-mentioned drum-side coupling devices 14, 15, snare drum carrier 21, tenor drum carrier 22, snare drum stand 31 and tenor drum stand 32 is omitted.

As shown in FIG. 9, the drum-side coupling device 16 includes a pair of coupling shafts 90, a pair of coupling fittings 93, to which each of the coupling shafts 90 is fixed, and a mount 94 for fixing the coupling fittings 93 to a shell 13*a* of the bass drum 13. The mount 94 is removeably attached to the shell 13*a* of the bass drum 13.

The bass drum carrier 23 includes the carrier main body 51, a pair of rods 95 and the carrier-side coupling device 26. The carrier-side coupling device 26 includes the pair of hooks 55*a* and 55*b* and a rectangular plate-like bridging member 96. In the case of the bass drum 13 shown in FIG. 9, the two drum-side coupling devices 16 are located on an outer circumferential surface of the shell 13*a* to be spaced apart.

The bridging member 96 serves as a bridge between the hooks 55*a* and 55*b* and is directly fixed to a front surface of an upper part of the carrier main body 51. Each of the rods 95 is attached to the holder 53 of the carrier main body 51 with its front end being oriented upward or downward, according to the diameter of the bass drum 13 attached to the bass drum carrier 23.

Figure 11A:
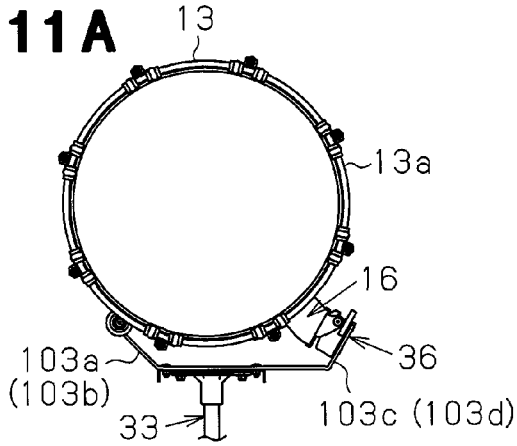
FIG. 11A is a side view showing the state where the small-sized bass drum is attached to the bass drum stand.
Figure 11B:
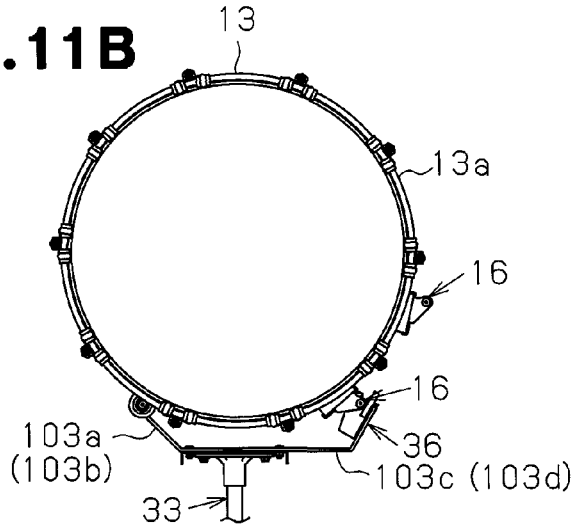
FIG. 11B is a side view showing the state where the medium-sized bass drum is attached to the bass drum stand.
Figure 11C:
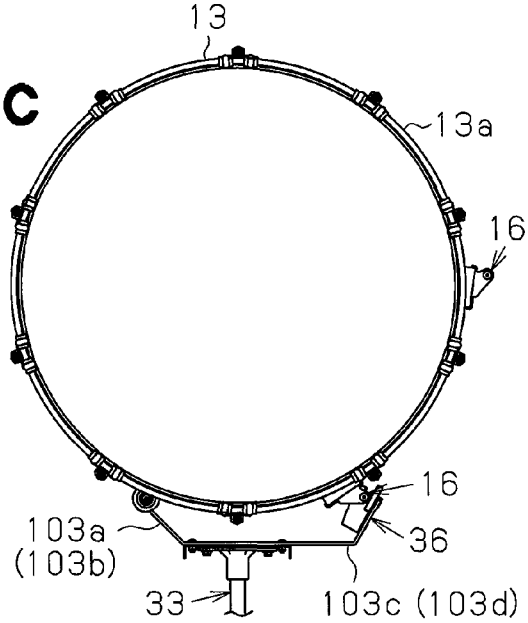
FIG. 11C is a side view showing the state where the large-sized bass drum is attached to the bass drum stand.

The bass drum stand 33 includes a stand main body 101, a flat plate 102 fixed to an upper end of the stand main body 101, four frames 103*a* to 103*d* fixed to the flat plate 102, and the stand-side coupling device 36. As shown in FIGS. 11A to 11C, the pair of frames 103*a*, 103*b* shown in the left of FIG. 9 among the four frames 103*a* to 103*d* function as retainers for stabilizing the attitude of the bass drum 13 attached to the bass drum stand 33. The pair of frames 103*c*, 103*d* shown in the right of FIG. 9 function as fixing members for fixing the stand-side coupling device 36 to the flat plate 102. The stand-side coupling device 36 includes the pair of hooks 65 to which the frames 103*c*, 103*d* are fixed, respectively, and a rectangular plate-like bridging member 106 fixed to the hooks 65.

Next, operation of the drum coupling system 10 will be described with reference to FIGS. 10A to 10C and 11A to 11C.

Figure 10A:
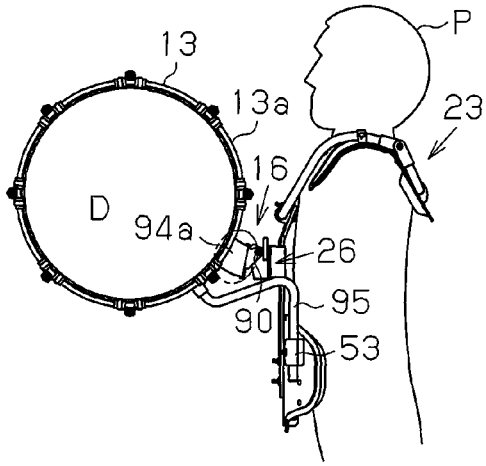
FIG. 10A is a side view showing the state where a small-sized bass drum is attached to the bass drum carrier.

As shown in FIG. 10A, when the drum coupling system 10 is applied to a bass drum 13 having a small diameter, a first mount 94*a* is used as a mount for the drum-side coupling device 16 and only one drum-side coupling device 16 needs to be attached to the outer circumferential surface of the shell 13*a*. The rods 95 are inserted into the holders 53 from above and used with their front ends being oriented upward. Then, the drum-side coupling device 16 is coupled to the carrier-side coupling device 26, and thereby the bass drum 13 is supported by the carrier-side coupling device 26 and by the rods 95 in the state where a beating surface D is located at a relatively high position. As shown in FIG. 11A, when the small-sized bass drum 13 is mounted on the bass drum stand 33, the drum-side coupling device 16 is coupled to the stand-side coupling device 36, thereby attaching the bass drum 13 to the bass drum stand 33. The small-sized bass drum 13 refers to a bass drum 13 having a diameter of 14 to 20 inches.

Figure 10B:
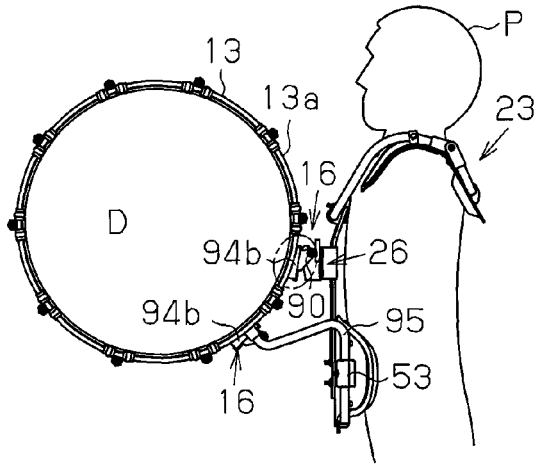
FIG. 10B is a side view showing the state where a medium-sized bass drum is attached to the bass drum carrier.

As shown in FIG. 10B, when the drum coupling system 10 is applied to the medium-sized bass drum 13 having a larger diameter than that of the bass drum 13 in FIG. 10A, a second mount 94*b* that is smaller than the first mount 94*a* is used as a mount of the drum-side coupling device 16 and the two drum-side coupling devices 16 are located on the outer circumferential surface of the shell 13*a* and are spaced apart. The rods 95 are inserted into the holders 53 from above and used with their front ends being oriented upward, as shown. Then, one of the drum-side coupling devices 16 is coupled to the carrier-side coupling device 26 to attach the bass drum 13 to the bass drum stand 33. Since the second mount 94*b* is used as the mount in this case, the bass drum 13 is supported by the carrier-side coupling device 26 and the rods 95 at a location closer to a player P as compared to the case shown in FIG. 10A. On the other hand, as shown in FIG. 11B, when the medium-sized bass drum 13 is mounted on the bass drum stand 33, the other of the two drum-side coupling devices 16 is coupled to the stand-side coupling device 36. In this manner, the orientation in the circumferential direction of the bass drum 13 at attachment as shown in FIG. 10B and at mounting as shown in FIG. 11B is kept almost uniform. A medium-sized bass drum 13 refers to a bass drum 13 having a diameter of 22 to 26 inches.

Figure 10C:
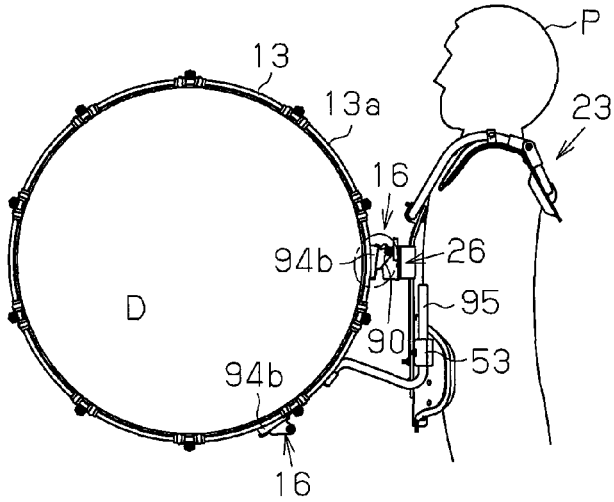
FIG. 10C is a side view showing the state where a large-sized bass drum is attached to the bass drum carrier.

As shown in FIG. 10C, when the large-sized bass drum 13 having a larger diameter than that of the bass drum 13 shown in FIG. 10B is used with the drum coupling system 10, the second mount 94*b* is used as a mount of the drum-side coupling device 16, and the two drum-side coupling devices 16 are spaced apart on the outer circumferential surface of the shell 13*a*. The rods 95 are inserted into the holders 53 from below and used with their front ends oriented downward, as shown in FIG. 10C. Then, one of the drum-side coupling devices 16 is coupled to the carrier-side coupling device 26 to attach the bass drum 13 to the bass drum stand 33. In this case, since the rods 95 are inserted into the holders from below, the bass drum 13 is supported by the carrier-side coupling device 26 and the rods 95 in the state where the beating surface D is located at a lower position as compared to the case shown in FIG. 10B. On the other hand, as shown in FIG. 11C, when the large-sized bass drum 13 is mounted on the bass drum stand 33, the other of the drum-side coupling devices 16 is coupled to the stand-side coupling device 36. In this manner, like the case shown in FIG. 10B, the orientation in the circumferential direction of the bass drum 13 at attachment as shown in FIG. 10C and at mounting as shown in FIG. 11C is kept almost uniform. A large-sized bass drum 13 refers to a bass drum 13 having a diameter of 28 to 32 inches.

According to this embodiment, following advantages can be obtained.

(1) Since, in the drum coupling system 10, the coupling structure for coupling a marching drum to a marching carrier and the coupling structure for coupling a marching drum to a drum stand are the same, a player can attach the marching drum to the marching carrier or the drum stand with the same operating method. Thus, the burden related to the attaching operation of the marching drum to the marching carrier or the drum stand is reduced or eliminated.

(2) The snare drum carrier 21 includes the carrier main body 51, the pair of rods 52, and the carrier-side coupling device 24. The tenor drum carrier 22 includes the carrier main body 51, the pair of rods 75, and the carrier-side coupling device 25. The bass drum carrier 23 includes the carrier main body 51, the pair of rods 95, and the carrier-side coupling device 26. In the drum coupling system 10, when attached to the front ends of the rods 52, 75, respectively, the carrier-side coupling device 24, 25 can be used as the snare drum carrier 21 and the tenor drum carrier 22. When attached to the front surface of the carrier main body 51, the carrier-side coupling device 26 can be used as the bass drum carrier 23. In these cases, since the carrier main body 51, which serves as a main part of the marching carrier, can be used as a common part, the number of parts for the entire drum coupling system 10 can be greatly reduced. In addition, a player can attach the various marching drums to respective marching carriers according to the same operating method.

(3) Each of the rods 52, 75 is removably attached to the carrier main body 51. For example, when used for the snare drum carrier 21 or the tenor drum carrier 22, the rods 52 and the rods 75 are replaced with each other depending on the type of marching drum. Thereby, the snare drum 11 and the tenor drum 12 each can be supported at an easy-to-play position. When used for the bass drum carrier 23, the rods 95 may be turned upside down according to the diameter of the bass drum 13. Thereby, various bass drums 13 having different diameters each can be supported at an easy-to-play position.

(4) The carrier-side coupling device 24 includes the lock mechanism for locking the coupling shafts 41 to prevent the coupling shafts 41 from escaping from the hooks 55*a* and 55*b*. Since the coupling shafts 41 are locked so that they may not escape from the hooks 55*a* and 55*b* by the lock mechanism, the marching drum can be reliably attached to the snare drum carrier 21 and the snare drum stand 31. Furthermore, at a parade involving motion during music playing, the snare drum 11 can be held to prevent separation from the snare drum carrier 21. The same advantages can be achieved in the marching carriers such as the tenor drum carrier 22 and the bass drum carrier 23 as well as the drum stands such as the tenor drum stand 32 and the bass drum stand 33.

(5) The carrier-side coupling device 24 further includes the angle adjusting mechanism for adjusting the angle of the beating surface of the snare drum 11 attached to the snare drum carrier 21. By pivoting the snare drum 11 about the coupling shafts 41 by the angle adjusting mechanism, the angle of the beating surface of the snare drum 11 can be adjusted so that the player can easily beat the drum. The same advantage can be achieved also in the tenor drum carrier 22.

(6) The third wall surface 24*c* that comes in contact with the bolt 60 in a tilted-up state of the snare drum 11 is provided on the upper end of the carrier-side coupling device 24. This third wall surface 24*c* together with the bolt 60 of the drum-side coupling device 14 constitutes the restricting device for restricting the snare drum 11 from pivoting about the coupling shafts 41 beyond the first angle $\alpha$. This restricting device prevents the snare drum 11 from pivoting about the coupling shafts 41 beyond the first angle $\alpha$ and from making contact with the snare drum carrier 21. Thus, it is possible to prevent both the snare drum 11 and the snare drum carrier 21 from being scratched or broken.

(7) The bridging member 56 is pivotably attached to the lower end of the first hook 55*a* to serve as a bridge between the first and second hooks 55*a* and 55*b*. The bridging member 56 can set the pitch between the hooks 55*a* and 55*b* to a uniform distance and keep the hooks 55*a* and 55*b* horizontal. Thereby, the snare drum 11 can be easily and smoothly attached to and removed from the snare drum carrier 21. The same effects can be achieved also with the tenor drum carrier 22.

(8) The drum-side coupling device 16 includes the pair of coupling shafts 90, the pair of coupling fittings 93, and the mount 94 for fixing the coupling fittings 93 to the bass drum 13. The mount 94 is removably attached to the shell 13*a* of the bass drum 13. By replacing the mounts 94*a*, 94*b* with each other according to the diameter of the bass drum 13, the distance between the center of each coupling shaft 41 and the bass drum 13 can be changed. For this reason, the player can support the various bass drum 13 having different diameters at an easy-to-play position.

(9) The snare drum stand 31 includes the stand main body 61, the coupling pipe 62, the stopper 63, the supporting part 64, and the stand-side coupling device 34. The tenor drum stand 32 includes the stand main body 81, the movable pipes 82, the fixed pipe 83, and the stand-side coupling device 35. The bass drum stand 33 includes the stand main body 101, the flat plate 102, the four frames 103*a* to 103*d*, and the stand-side coupling device 36. In the drum coupling system 10, in forming the drum stands for the various marching drums, as in the case of the marching carrier, the stand main bodies 61, 81, 101 as main parts of the drum stands can be used as a common part. For this reason, the number of parts of the whole drum coupling system 10 can be greatly reduced. Further, the player can attach the various marching drums to the respective drum stands according to the same operating method.

(10) The resin cylindrical body 41*c* is attached to the shaft part 41*a* of the coupling shaft 41. With this configuration, the resin cylindrical body 41*c* can prevent noise caused by rubbing or contact between metal parts in the coupling part of the snare drum 11 and the snare drum carrier 21.

(11) The metal plate member 54 is fixed to each of the back surfaces of the hooks 55*a* and 55*b*. With this configuration, as represented by the lines formed by a long dash alternating with two short dashes in FIGS. 4A and 4B, while the lock lever 57 is switched to the locked position, the exposed part of the plate member 54 can support the resin lock lever 57 from the rear. Thus, the lock lever 57 can be prevented from being broken due to application of excessive force at manipulation of the lock lever 57 or due to frequent manipulation of the lock lever 57.

(12) The resin cap 54*e* is attached to the front end of the lower bolt 54*b*. With this configuration, the cap 54*e* can hold the rods 52 so that the rods 52 may not be disengaged from the lower holes 55*d* of the hooks 55*a* and 55*b*. Furthermore, when receiving excessive force, the hooks 55*a* and 55*b* can be prevented from rotating relative to the rods 52.

The present embodiment may be modified as follows.

Figure 12:
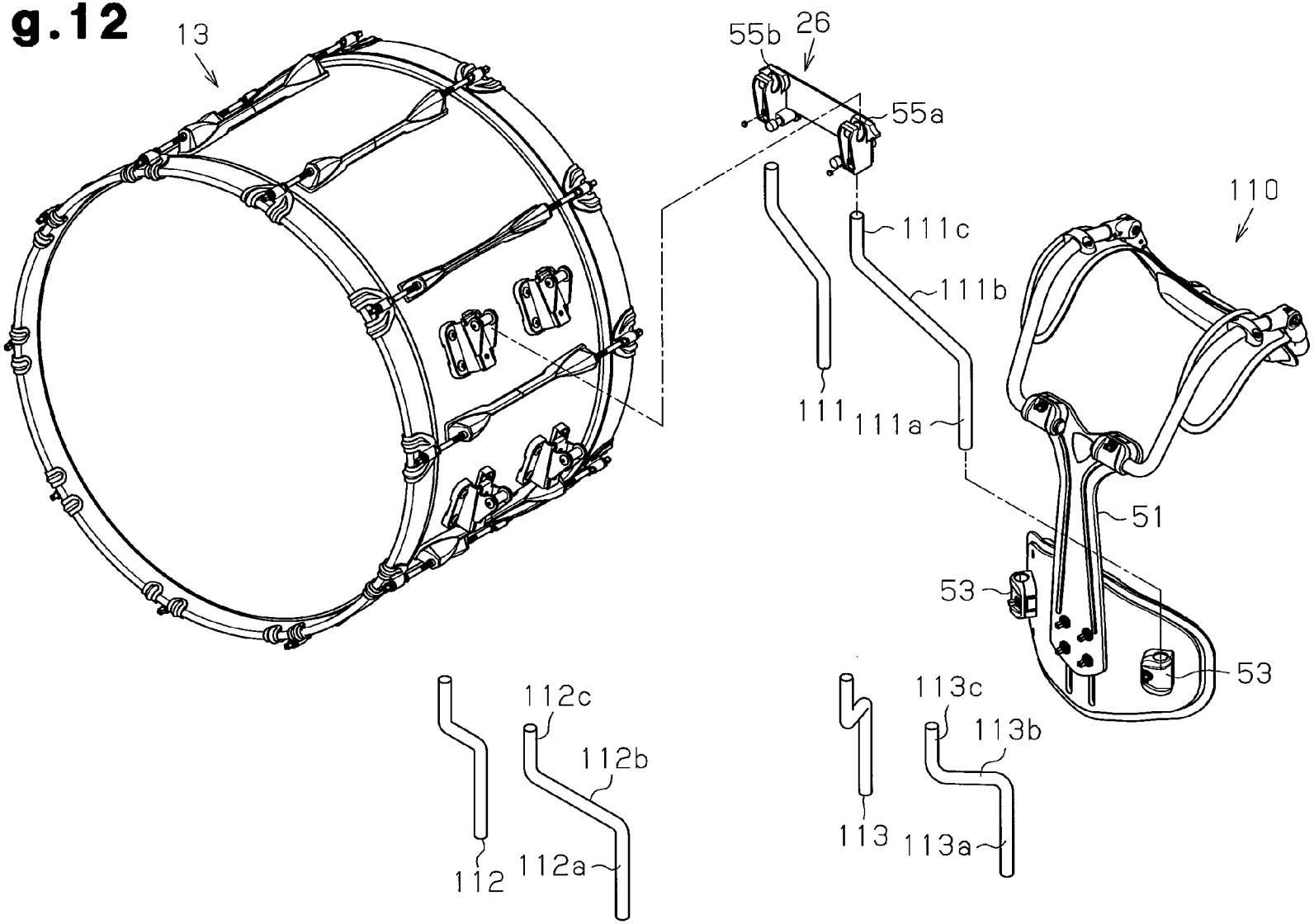
FIG. 12 is a schematic perspective view showing the bass drum and the bass drum marching carrier, to which the drum coupling system is applied, in a modification.
Figure 13C:
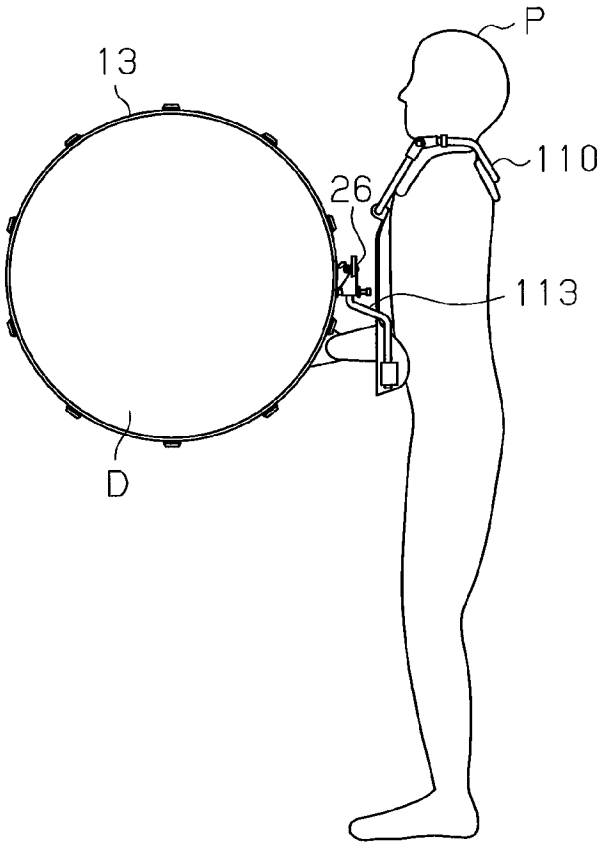
FIG. 13C is a side view showing the large-sized bass drum is attached to the bass drum carrier in a modification.

The bass drum carrier may be changed as shown in FIGS. 12 to 13C. A bass drum carrier 110 shown in FIG. 12 differs from the bass drum carrier 23 shown in FIG. 9 in that the carrier-side coupling device 26 is not fixed to the carrier main body 51 but is fixed to rods 111, 112 or 113. The bass drum carrier 110 includes the carrier main body 51, the pair of rods 111, 112 or 113 and the carrier-side coupling device 26. The rods 111 to 113 have bottom end parts 111*a* to 113*a* fixed to the holders 53 of the carrier main body 51, intermediate parts 111*b* to 113*b* extending forward from upper ends of the bottom end parts and front end parts 111*c* to 113*c* which extend upward from front ends of the intermediate parts and to which the carrier-side coupling device 26 is fixed, respectively. The rods 111 to 113 each have appropriate shape and length and are selected and replaced according to the diameter of the bass drum 13 attached to the bass drum carrier 110. The rods 111 to 113 each are attached to the carrier main body 51, and their front end parts 111*c* to 113*c* are oriented in an upward direction, as shown in FIG. 12.

Figure 13B:
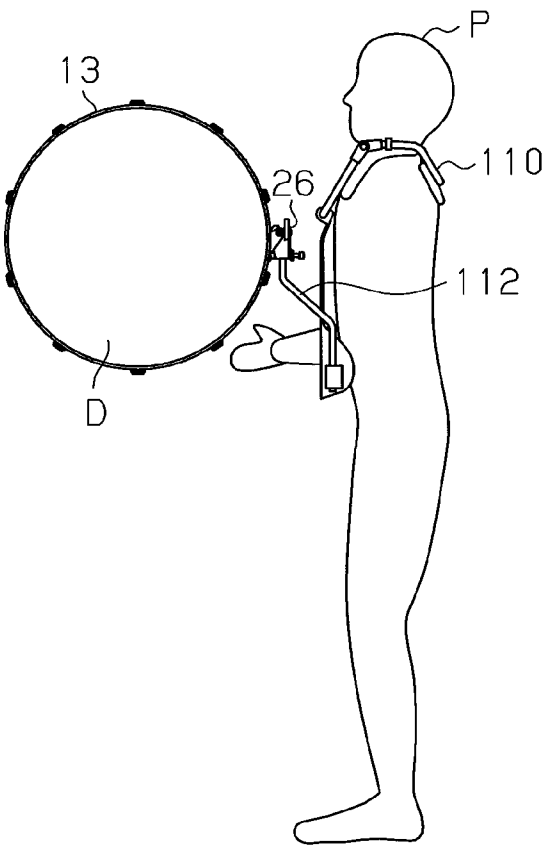
FIG. 13B is a side view showing the medium-sized bass drum is attached to the bass drum carrier in a modification.
Figure 13A:
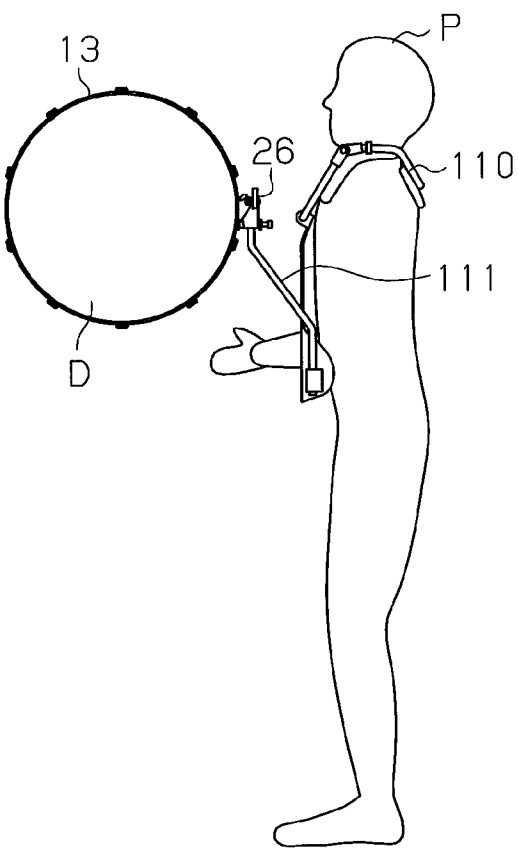
FIG. 13A is a side view showing the small-sized bass drum is attached to a bass drum carrier in a modification.

Specifically, in the case of a small-sized bass drum 13, which has a diameter of 14 to 20 inches, the rods 111, in which the whole length of the intermediate parts 111*b* is relatively long and the height distance between the bottom end parts 111*a* and the front end parts 111*c* is relatively large, are used. In this case, as shown in FIG. 13A, when the bass drum 13 is fixed to the carrier-side coupling device 26, the rods 111 can support the small-sized bass drum 13 in the state where the beating surface D is located at a relatively high position. In the case of the medium-sized bass drum 13 having a diameter of 22 to 26 inches, the rods 112 are used, in which the whole length of the intermediate part 112*b* is smaller and the height distance between the bottom end part 112*a* and the front end part 112*c* is smaller as compared to the case of attaching the small-sized bass drum 13. In this case, as shown in FIG. 13B, when the bass drum 13 is fixed to the carrier-side coupling device 26, the rods 112 can support the medium-sized bass drum 13 at a position closer to the player P as compared to the case of attaching the small-sized bass drum 13. In the case of the large-sized bass drum 13 having a diameter of 28 to 32 inches, the rods 113 are used, in which the whole length of the intermediate part 113*b* is further smaller and the height distance between the bottom end part 113*a* and the front end part 113*c* is further smaller as compared to the case of attaching the medium-sized bass drum 13. In this case, as shown in FIG. 13C, when the bass drum 13 is fixed to the carrier-side coupling device 26, the rods 113 can support the large-sized bass drum 13 at a position closer to the player P as compared to the case of attaching the medium-sized bass drum 13.

Thus, by adopting the bass drum carrier 110 shown in FIG. 12, like the snare drum carrier 21 and the tenor drum carrier 22, it is possible to fix the carrier-side coupling device 26 to the rods 111 to 113. For this reason, the carrier main body 51, which is a main part of the marching carrier, can be shared as a common part by the snare drum carrier 21, the tenor drum carrier 22, and the bass drum carrier 110. Accordingly, the number of parts of the whole drum coupling system 10 can be further reduced as compared to the case of adopting the bass drum carrier 23 shown in FIG. 9. In the case of adopting the bass drum carrier 110 shown in FIG. 12, since the rods 111, 112 or 113 need to support the bass drum 13 at two points, it is preferred to provide a reinforcing member at a position corresponding to the drum-side coupling device 16 on the back surface of the shell of the bass drum 13.

The drum coupling system 10 is configured as the coupling system for coupling the various marching drums such as the snare drum 11, the tenor drum 12 and the bass drum 13 to the respective marching carriers such as the snare drum carrier 21, the tenor drum carrier 22 and the bass drum carrier 23 as well as the respective drum stands such as the snare drum stand 31, the tenor drum stand 32 and the bass drum stand 33. Alternatively, the drum coupling system 10 may be configured as a coupling system for coupling various marching drums other than the bass drum 13 to marching carriers other than the bass drum carrier 23 and the drum stands other than the bass drum stand 33. Further, the drum coupling system 10 may be configured as a coupling system for coupling various marching drums other than the snare drum 11 to marching carriers other than the snare drum carrier 21 and to drum stands other than the snare drum stand 31. Further, the drum coupling system 10 may be configured as a coupling system for coupling various marching drums other than the tenor drum 12 to marching carriers other than the tenor drum carrier 22 and to drum stands other than the tenor drum stand 32.

The lock mechanism for locking the coupling shafts 41 to prevent the coupling shafts 41 from escaping from the hooks 55*a* and 55*b* may be omitted from the carrier-side coupling device 24. Further, the above-mentioned lock mechanism may be omitted also in the marching carriers such as the tenor drum carrier 22 and the bass drum carrier 23 as well as the drum stands such as the tenor drum stand 32 and the bass drum stand 33.

The angle adjusting mechanism for adjusting the angle of the beating surface of the snare drum 11 attached to the snare drum carrier 21 may be omitted from the carrier-side coupling device 24. Further, the above-mentioned angle adjusting mechanism may be omitted also in the tenor drum carrier 22.

The bridging member 56 may be omitted from the carrier-side coupling device 24 of the snare drum carrier 21. Similarly, the bridging member 86 may be omitted from the tenor drum carrier 22.

While the above description is of preferred embodiments of the present invention, it should be appreciated that the invention may be modified, altered, or varied without deviating from the scope and fair meaning of the following claims.

The invention claimed is:

1. A drum coupling system adapted for coupling a marching drum to a marching carrier used for attaching the marching drum to a player's body or a drum stand used to mount the marching drum thereon, wherein the marching drum is a snare drum, a tenor drum or a bass drum, the drum coupling system comprises a carrier side coupling device for coupling the marching drum to the marching carrier and a stand coupling device for coupling the marching drum to the drum stand, and the coupling structures of the devices are the same for the different types of drums and the stand, the marching carrier includes a carrier main body, at least one supporting member for supporting the marching drum, at least one different supporting member for use with a marching bass drum and a carrier-side coupling device for coupling to the marching drum, and when the marching carrier is used as a snare drum carrier or a tenor drum carrier, the carrier-side coupling device is attached to a front end of the supporting member, and when the marching carrier is used as a bass drum carrier, the carrier-side coupling device is attached to a front surface of the carrier or the front end of the at least one different supporting member for use with a marching bass drum.

2. The drum coupling system according to claim 1, wherein the supporting member and the different supporting member each comprises a pair of rods, the rods are removably attached to the carrier main body.

3. The drum coupling system according to claim 2, wherein the carrier-side coupling device includes a hook for pivotably supporting a coupling shaft provided on the marching drum and a lock mechanism for locking the coupling shaft so as not to disengage the coupling shaft from the hook.

4. The drum coupling system according to claim 3, wherein the lock mechanism includes a lock lever pivotably supported by the hook, the hook is provided with a supporting member for supporting the lock lever from the rear, and the supporting member holds the lock lever between itself and the hook and is attached to the hook so as to expose a part of the supporting member when the hook is viewed from the front.

5. The drum coupling system according to claim 3, wherein the carrier-side coupling device further includes an angle adjusting mechanism for adjusting the angle of a beating surface of the marching drum by pivoting the marching drum about the coupling shaft.

6. The drum coupling system according to claim 3, wherein the carrier-side coupling device further includes a restricting means for restricting the marching drum from pivoting around the coupling shaft beyond a first angle.

7. The drum coupling system according to claim 3, wherein the hook is one of a pair of hooks, which are attached to each of the pair of rods, and the carrier-side coupling device further includes a bridging member for serving as a bridge between the hooks.

8. The drum coupling system according to claim 3, wherein when the marching drum is a bass drum, the bass drum is provided with a mount for fixing the coupling shaft to the bass drum, and the mount is replaced according to the diameter of the bass drum.

9. The drum coupling system according to claim 1, wherein the drum stand includes a stand main body, a stand-side coupling device coupled to the marching drum, and a stopper for supporting the marching drum together with the stand-side coupling device, and the stand-side coupling device is attached to an upper end of the stand main body.

10. The drum coupling system according to claim 9, wherein the bass drum includes two drum-side coupling devices, when the marching drum is the bass drum, the two drum-side coupling devices are located on an outer circumferential surface of the bass drum to be spaced apart.

* * * * *